US006113478A

United States Patent [19]

Anderson, III et al.

[11] Patent Number: 6,113,478

[45] **Date of Patent: *Sep. 5, 2000**

[54] POLISHING APPARATUS WITH IMPROVED ALIGNMENT OF POLISHING PLATES

[75] Inventors: Robert L. Anderson, III, Scottsdale, Ariz.; John Hosé, Versailles, Ky.

[73] Assignee: Speedfam-IPEC Corporation, Chandler, Ariz.

[ * ] Notice: This patent is subject to a terminal disclaimer.

[21] Appl. No.: 09/099,638

[22] Filed: Jun. 18, 1998

Related U.S. Application Data

[63] Continuation-in-part of application No. 09/017,645, Feb. 2, 1998, Pat. No. 5,997,390.

[51] Int. Cl.[7] ..... B24B 7/00

[52] U.S. Cl. ..... 451/262; 451/261; 451/286; 451/288; 451/269

[58] Field of Search ..... 451/268, 269, 451/261, 262, 291, 292, 288, 286

[56] References Cited

U.S. PATENT DOCUMENTS

| | | | |
|---|---|---|---|
| 843 | 7/1838 | Bunnel | 451/269 |
| 2,618,911 | 11/1952 | Indge . | |
| 2,688,215 | 9/1954 | Roshong et al. | 451/268 |
| 2,963,830 | 12/1960 | Hook . | |
| 3,691,697 | 9/1972 | Bender | 451/269 |
| 4,272,924 | 6/1981 | Masuko et al. | 451/268 |
| 4,315,383 | 2/1982 | Day . | |
| 4,707,945 | 11/1987 | Arai . | |
| 4,860,498 | 8/1989 | Gosis . | |
| 5,099,614 | 3/1992 | Arai et al. | 451/268 |
| 5,595,529 | 1/1997 | Cesna et al. . | |
| 5,944,591 | 8/1999 | Chen | 451/290 |

OTHER PUBLICATIONS

SpeedFam–Spitfire Brochure entitled "Double–Sided Abrasive Machining System 360", Copyright 1994.

SpeedFam Brochure entitled "SpeedFam® Double–Sided Abrasive Machines".

*Primary Examiner*—David A. Scherbel
*Assistant Examiner*—G. Nguyen
*Attorney, Agent, or Firm*—Fitch, Even, Tabin & Flannery

[57] ABSTRACT

In a polishing machine for simultaneous double-sided polishing of workpieces between upper and lower polish tables, the upper polish table has a hollow center telescopically receiving in a drive hub supported from below. The upper polish plate is suspended by a lifting rod from a double-ended main lifting cylinder having upper and lower ends secured to a frame extending from the lower polish table.

8 Claims, 13 Drawing Sheets

POLISHING APPARATUS WITH IMPROVED ALIGNMENT OF POLISHING PLATES

CROSS-REFERENCE TO RELATED APPLICATIONS

This is a continuation-in-part of U.S. patent application Ser. No. 09/017,645 filed Feb. 2, 1998, U.S. Pat. No. 5,997,390.

BACKGROUND OF THE INVENTION

1. Field of the Invention

The present invention pertains to the polishing of commercially important articles, such as hard disk blanks, and in particular to the polishing of articles using free abrasive machining techniques.

2. Description of the Related Art

The polishing of thin, flat objects plays an important part in many commercial applications. For example, hard disk blanks are machined using free abrasive processes to flatten one or both major surfaces of the disk. Such flattening is carried out to a high degree of accuracy, so as to produce what is commonly termed a "mirror surface" or an "optically flat" surface. One example of a family of such machines is offered for sale by the Assignee of the present invention under the Model designation SFDSM. With these machines, both sides of a workpiece may be processed at the same time to achieve desired surface polishing.

In typical commercial scale operations, several workpieces are polished on one machine at one time. For example, in one type of polishing machine both major surfaces of the workpieces (e.g., memory disk blanks or disk substrates) are simultaneously polished using a planetary motion. In such "double sided" machines, provision is usually made to move the upper polish plate, workpieces (i.e., planetary carrier system), and lower polish plate independently of one another so as to achieve various, desired polishing results. In some machines of this type, the upper polish plate is conveniently driven from above. However, in other types of machines such as those addressed by the present invention, the upper polish plate is driven from below, using a drive hub located along the center axis of the polishing machine. Such arrangements have arisen, in part, since the upper and lower polishing plates typically have an annular configuration with central openings of substantial size. It is possible, therefore, to provide a plurality of concentric, nested drive arrangements in the base of the polishing machine in such a way that the drive systems do not interfere with one another and can be operated independently.

It is known to provide rotational drive for the upper plate using a slotted, upwardly extending hub. The slots extend in a vertical direction, the direction of travel of the upper plate as the plate is lowered onto the workpieces. Blade-like drive latches are pivotally mounted on the top side of the upper plate and have inner edges received in the slots so as to be carried for rotation with the drive hub. During a polishing operation, radial and other lateral forces are developed between the upper polish plate and the drive hub, causing the latches to shift within the slots, resulting in a changing depth of penetration of the latches within the slots. It is desirable, in general, to eliminate or reduce such lateral excursions, especially when such excursions are observed in members closely related to the polishing process.

Loading and unloading of the workpieces is typically accomplished by separating the upper and lower polish plates by a distance sufficient to allow a machine operator or an automated load/unload device to grasp and remove the workpieces, thereafter replacing the polished workpieces with fresh workpieces in preparation for a subsequent cycle of operation.

There have been constant ongoing demands within the industry to achieve workpiece surfaces of ever increasing flatness. Considerable effort and expense have been incurred and substantial improvements in surface flatness have been attained. However, end users of disk substrate workpieces require flatter surface finishes, in part, to improve hard disk storage densities and increasing data throughput rates.

SUMMARY OF THE INVENTION

It is an object of the present invention to provide an improved operation for polishing machines, especially those using free abrasive machining techniques to simultaneously polish opposed surfaces of the workpiece.

Another object of the present invention is to provide polishing machines of the above-described type in which the upper polish plate, workpieces, and lower polish plate are moved independently of one another so as to attain a variety of polishing performance.

Yet another object of the present invention is to provide polishing machines of the above-described type in which the upper polish plate is driven from below by a slotted drive hub. A related object of the present invention is to prevent randomly occurring lateral excursions of the upper polish plate with respect to the drive hub, during an ongoing polishing operation.

A further object of the present invention is to provide polishing machines of the above-described types which are capable of providing workpieces having improved surface flatness, resulting from improved alignment of the polish plates.

These and other objects according to principles of the present invention are provided in apparatus for polishing a workpiece, comprising:

a table for supporting the workpiece;

a frame extending above the table;

an upper polish head having an inner base wall defining a center opening and disposed above the table and movable toward the table so as to cooperate with the table to apply pressure to the workpiece to be polished, the upper polish head also movable away from the table to allow access to the workpiece for its removal from the apparatus;

a lifting cylinder having opposed upper and lower ends, carried by the frame with a portion of the lifting cylinder extending above the frame, the lifting cylinder suspending said upper polish head above the table by a lifting rod, the lifting rod movable within the main lifting cylinder so as to move the upper polish head toward and away from said table;

bracing means extending from the upper end of the lifting cylinder to the frame; and a drive hub mounted on the table for rotation about a hub axis, and telescopically receivable in the center opening of the upper polish head so as to engage the upper polish head as the upper polish head is moved toward the table.

DETAILED DESCRIPTION OF THE PREFERRED EMBODIMENT

Figure 1:
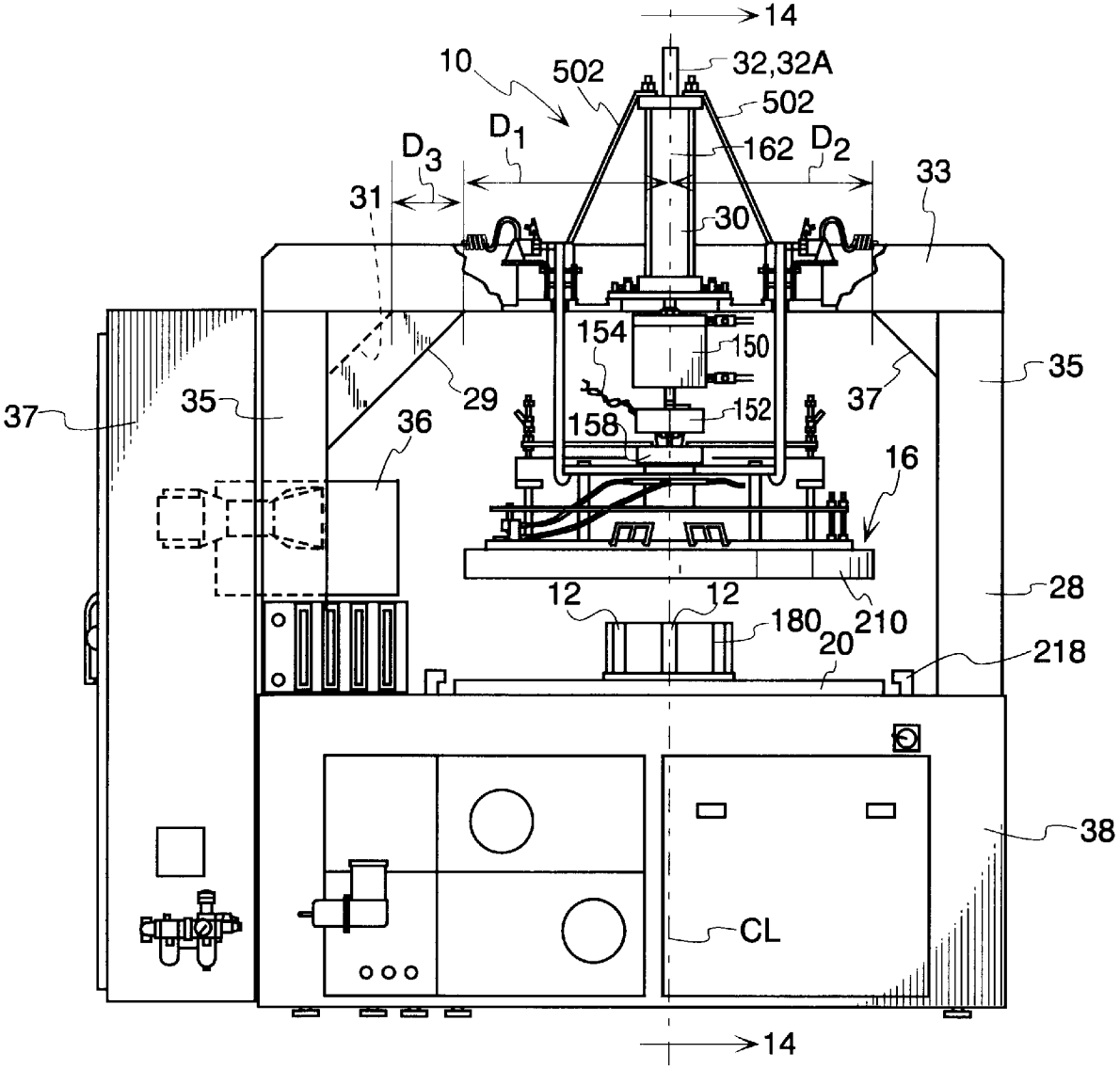
FIG. 1 is a front elevational view of a polishing machine according to principles of the present invention.

Referring now to the drawings, and initially to FIGS. 1–4, a polishing machine according to the principles of the present invention is generally indicated at 10. Polishing machine 10 includes a supporting frame including an upper frame portion 28 and a base 38. A polish table or lower polish plate 20 is mounted in base 28 for rotation about its central vertical axis under ongoing process control. Referring to FIG. 1, control box 36 is coupled to a control cabinet 37, containing conventional equipment for control of the operation of machine 10.

Figure 4:
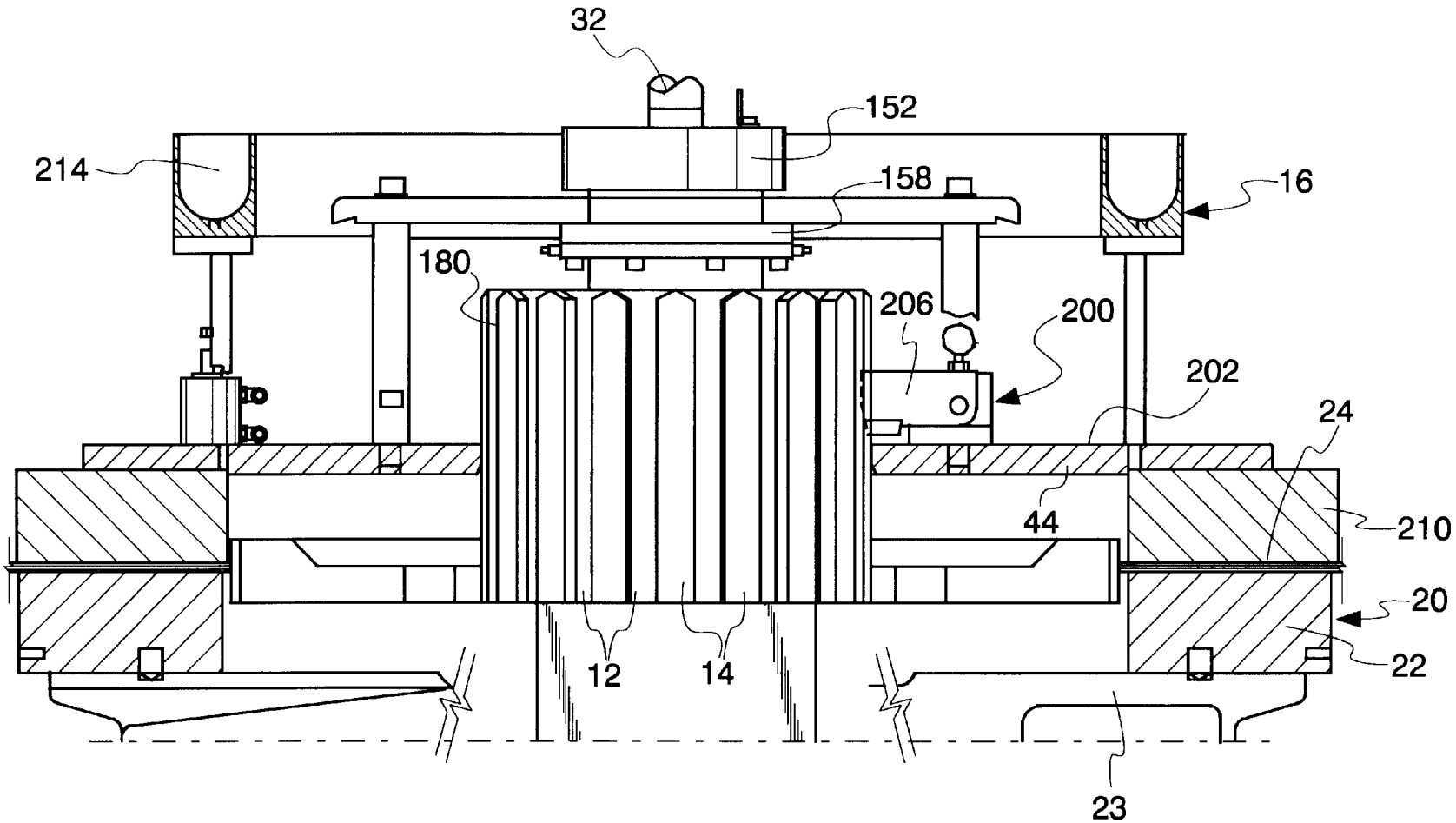
FIG. 4 is a cross-sectional view taken along the line 4—4 of FIG. 3.

An upper polish plate assembly 16 is hangingly suspended by a lifting rod 32 having an upper free end 32*a*. Referring to FIG. 4, the upper polish plate assembly 16 has an annular polish plate 210. Lifting rod 32 is mounted within main lifting cylinder 30, which in turn is supported by upper frame 28 including an equalizing gusset 29 supplementing the original (left hand) gusset 31 (see FIG. 1). The equalizing gusset 29 is provided to reduce the distance between the centerline CL of the polish plate assemblies to the nearest vertically supported portion of generally horizontal channel member 33 (i.e., that portion which receives support from the upright members 35 of base 28).

In a preferred embodiment illustrated in FIG. 1, upright support members 35 are joined at their upper ends to channel 33, thereby providing support for the weight of the channel 33 and the load supplied thereto. Of greatest concern here is the bowing deflection or sag of channel 33 under static loads (i.e., due to the weight of the channel and components joined thereto) as well as the dynamic loads applied to the channel (i.e., due to motion of the upper polish plate assembly 16 and its related components).

With the addition of equalizing gusset 29, distance $D_1$ as measured from the gusset 29 to the centerline CL is made equal to the distance $D_2$ as measured from the centerline CL to the gusset 37. In prior art arrangements, without the benefit of equalizing gusset 29, the distance from the centerline CL to the nearest vertical support is increased by the distance $D_3$ as indicated in FIG. 1. An increased distance of channel 33 to the left of the centerline CL results in an increased flexure of channel 33 to the left of centerline CL, thus altering the axis of lifting rod 32 which is ultimately carried by channel 33. With the equalizing gusset 29 in place, any deflection of channel 33 on either side of centerline CL is made uniform, thus preserving the alignment of the lifting rod with respect to the lower polish assembly which includes lower polish plate 20 and drive hub 180.

Figure 15:
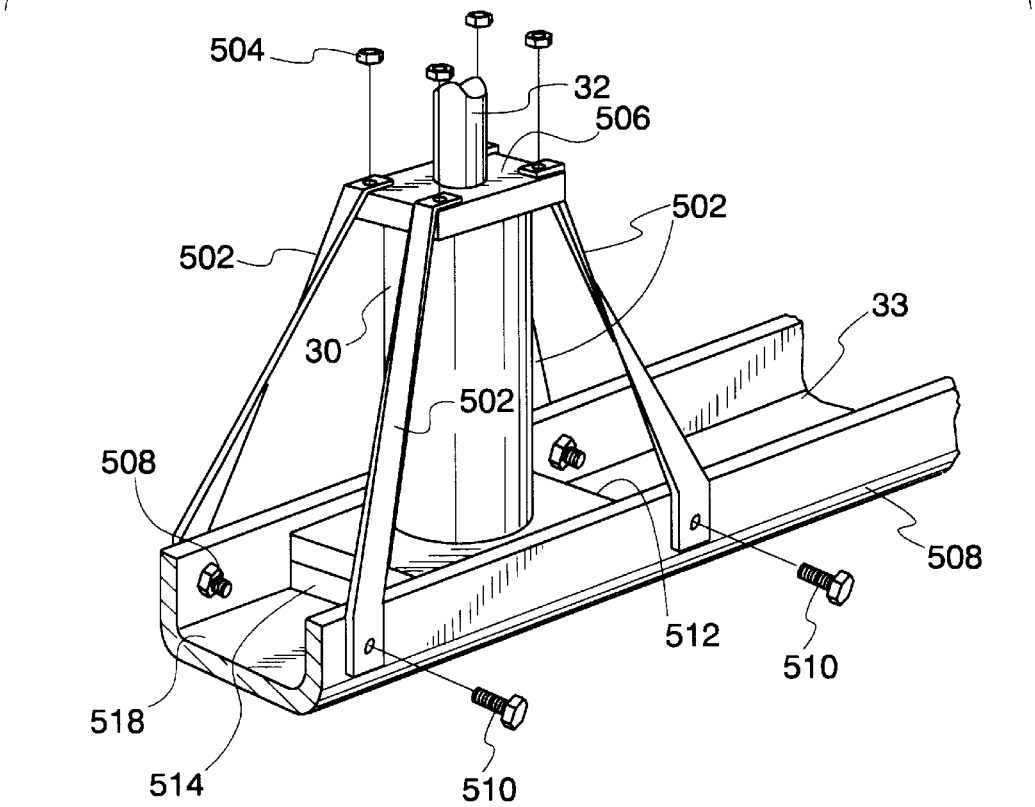
FIG. 15 is a perspective view thereof.

In order to further ensure proper alignment of the upper and lower polish plate assemblies, braces 502, extending from channel 33 to the upper end of main lifting cylinder 30, are added. As can be seen, for example, in FIG. 15, four braces 502 are employed. The upper ends of the braces 502 are coupled by threaded fasteners 504 to a mounting plate 506 located at the upper end of main lifting cylinder 30. The lower ends of the braces 502 are connected to the side walls 508 of channel 33 by threaded fasteners 510. The lower end of main lifting cylinder 30 is secured to the bottom plate 512. If desired, additional mounting plates such as the mounting plate 514 shown in FIG. 15 can be employed. The plates 512, 514 can also be bolted to the bottom web 518 of channel 33 using conventional threaded fasteners or the mounting plates 512, 514 can be welded to channel 33 in a known manner. In either event, the lower end of main lifting cylinder 30 is directly connected to channel 33 while the upper end of main lifting cylinder 30 is supported from channel 33 by the plurality of braces 502.

Figure 16:
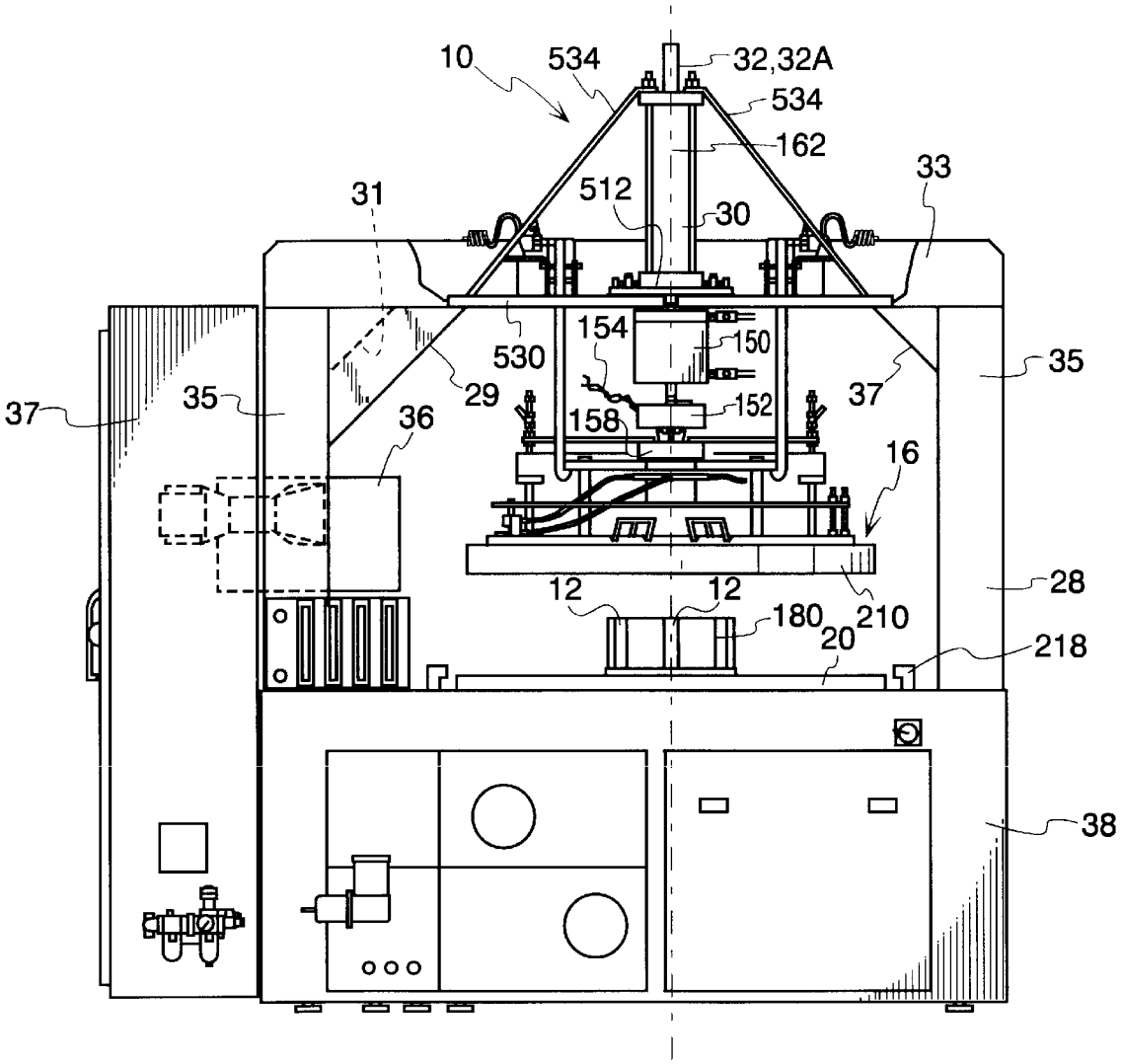
FIG. 16 is a view similar to that of FIG. 1 but showing an alternative construction.

Referring to FIG. 16, an alternative construction is illustrated, wherein a support plate 530 is secured to bottom plate 512 of main lifting cylinder 30 by bolt fasteners or other conventional fastener arrangements, including metallurgical joinder provided by welding, brazing or the like. As can be seen in FIG. 16, mounting plate 530 extends to the gussets 29, 37 thereby receiving direct support from upright portions 35 of the base 28. Further, as illustrated in FIG. 16, braces 534 extend from the upper end of main lifting cylinder 30 to points on channel 33 immediately adjacent the gussets 29, 37. Thus, the upper and lower ends of main lifting cylinder 30 receive support directly from the upright portions 35, via gussets 29, 37. In either mounting arrangement (i.e., mounting arrangements of either FIGS. 15 or 16) both the upper and lower portions of the main lifting cylinder receive additional support over that conventionally provided.

Figure 2:
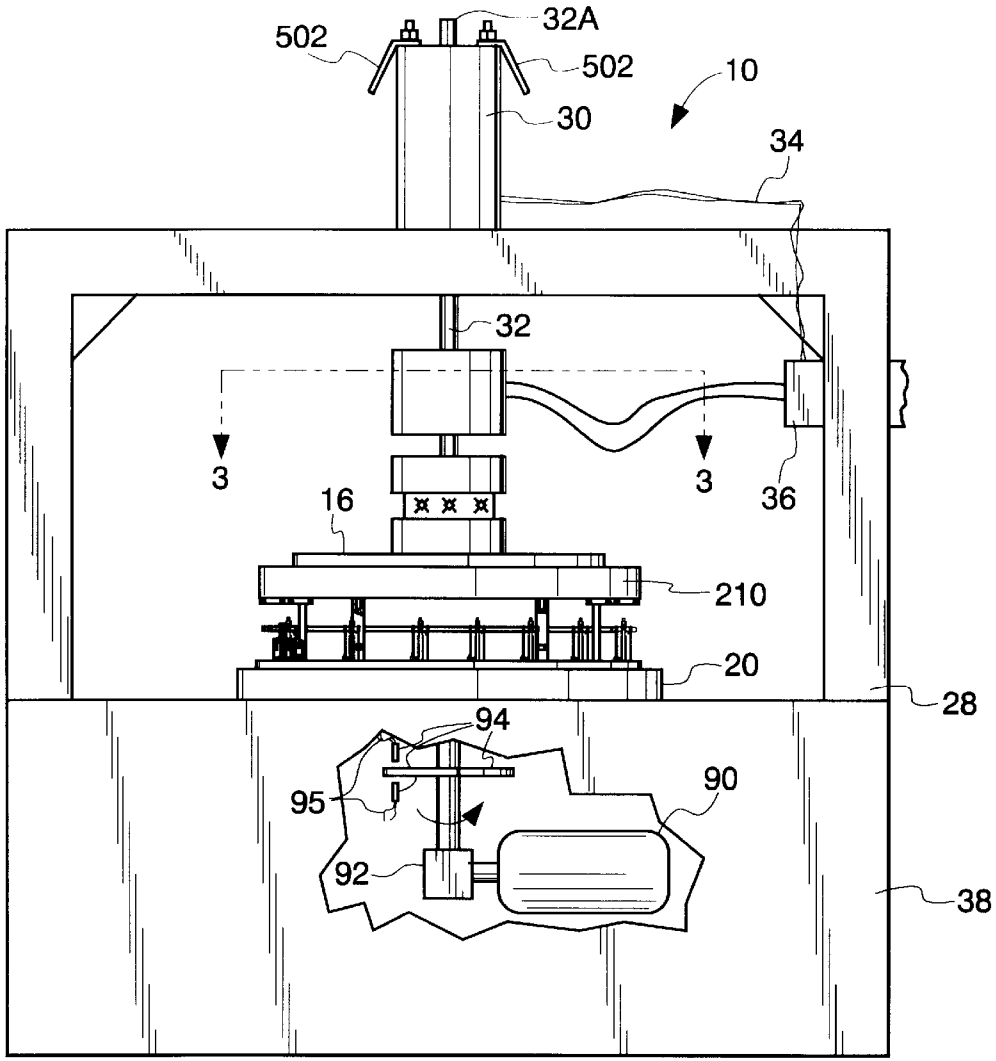
FIG. 2 is a simplified view of FIG. 1, shown partly broken away.

Referring to FIG. 2, control of main lifting cylinder 30 is provided by control lines 34 coupling the main lifting cylinder to control box 36 and equipment within control cabinet 37. The controls of the main lifting cylinder 30 are preferably of the hydraulic type but may also be pneumatic or electronic in form. In response to various operator control signals, main lifting cylinder 30 raises and lowers upper polish plate assembly 16 by extending and retracting lifting rod 32. Referring again to FIG. 1, the upper polish plate assembly 16 is coupled to lifting rod 32 through a number of components, including a conventional sub-cylinder 150 which is operable to control down pressure to workpieces throughout the machining cycle so as to produce precision polishing of the workpiece surfaces.

Additionally, the sub-cylinder 150 ensures that the upper polish plate assembly 16 may be gently lowered into contact with the workpiece surfaces, as the upper polish plate is advanced toward the lower polish plate 20, with extension of the lifting rod 32. The sub-cylinder 150 allows the lifting rod to be moved at a first higher speed to bring the upper pressure plate toward the workpieces to be polished. Thereafter, sub-cylinder 150 is employed for a slower, more gentle downward movement, bringing the upper pressure plate into contact with the workpieces. Further, during a polishing operation, the sub-cylinder 150 can be operated so as to "ramp-up" and/or "ramp-down" forces on the workpieces as the process requires.

The transducer 152 provides electrical signals 154 indicative of the down force on the workpieces being polished. Conductors 154 are coupled to control box 36 and equipment located within control panel 37 to provide an ongoing control during the polishing operation. A gimbal 158 is provided at the interface between the lifting rod assembly and upper polish plate assembly 16 so as to allow the upper polish plate assembly 16 to swing a limited amount under carefully controlled conditions, while maintaining the lifting rod 32 rigidly aligned along the central vertical axis of the machine (indicated by reference numeral 162).

Machine 10 preferably comprises a class of polishing machines which perform a double sided polishing in a single machine cycle. Examples of such machines are commercially available from the assignee of the present invention, and are identified as the "DSM Series Double Sided Machines" and also as "SpeedFam Planetary Grinding and Polishing Machines". As mentioned, the preferred polishing process is carried out using free abrasive machining techniques and, accordingly, a slurry delivery system including a ring-like trough 214 is provided to deliver slurry between the polish plates 22, 210. With reference again to FIG. 3, an outer containment ring 218 surrounds the lower pressure plate 22 and extends at least partly above the lower surface of upper polish plate 210, so as to contain slurry or other polishing media.

Figure 3:
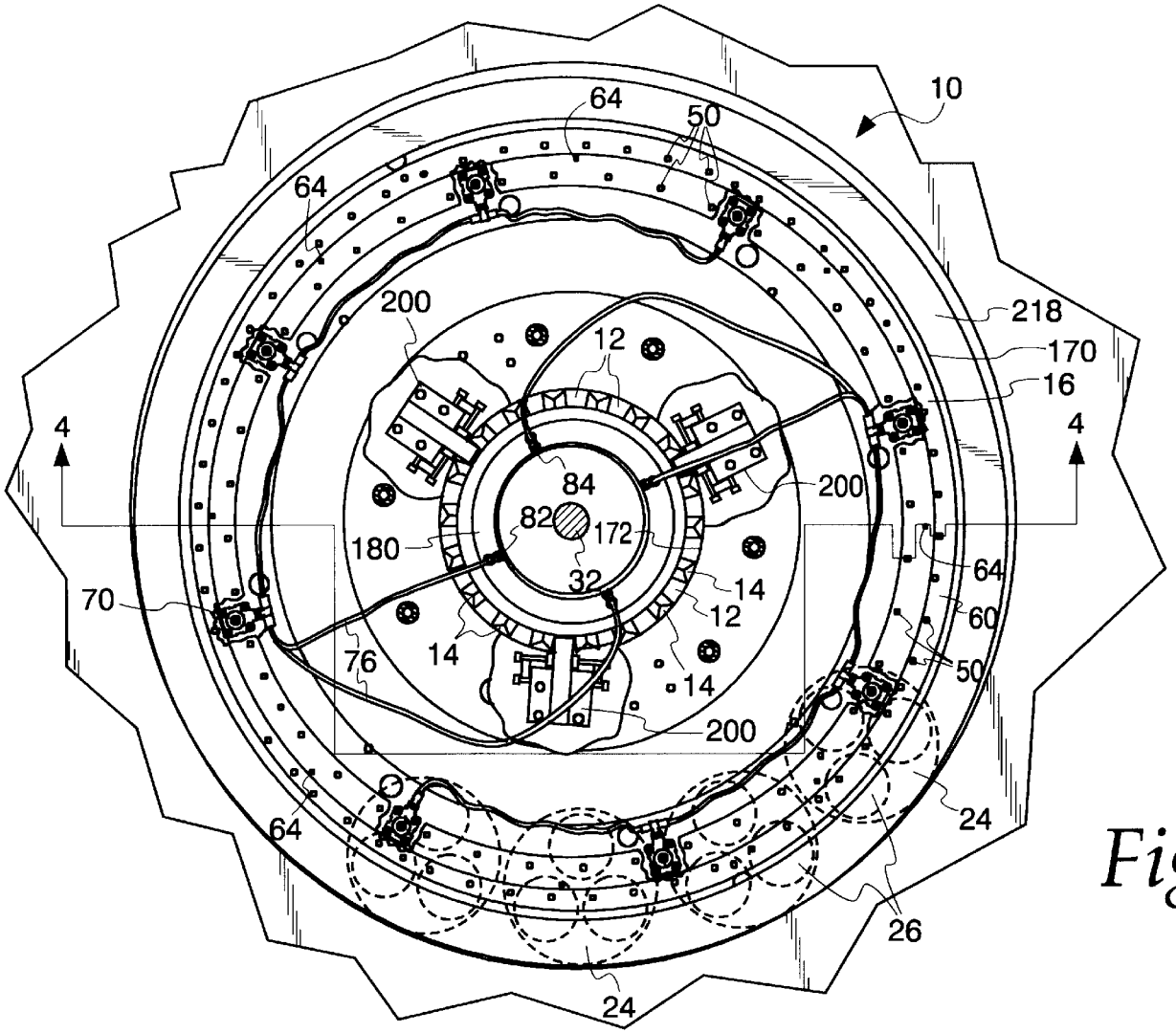
FIG. 3 is a cross-sectional view taken along the line 3—3 of FIG. 2.

Considering the coaxial alignment of the machine components in further detail, the lower polish plate 20 is mounted within base 38 and ample room is provided for a massive, stable mounting for the lower pressure plate and its associated drive systems. In order to provide the flexibility of operation and range of control needed to produce superior polishing results, it is preferable to provide a rotational drive for the upper polish plate assembly 16 from below. With reference to FIG. 3, upper polish plate assembly 16 has an annular form when viewed from above, with an outer edge 170 and a bore wall or inner edge 172, defining a central opening of the upper polish plate. A drive hub 180 is supported from base 38 and extends through the hollow center formed in lower polish plate 20 so as to protrude in an upward direction above the upper surface of polish plate 20 as can be seen, for example, in FIG. 1.

Figure 5:
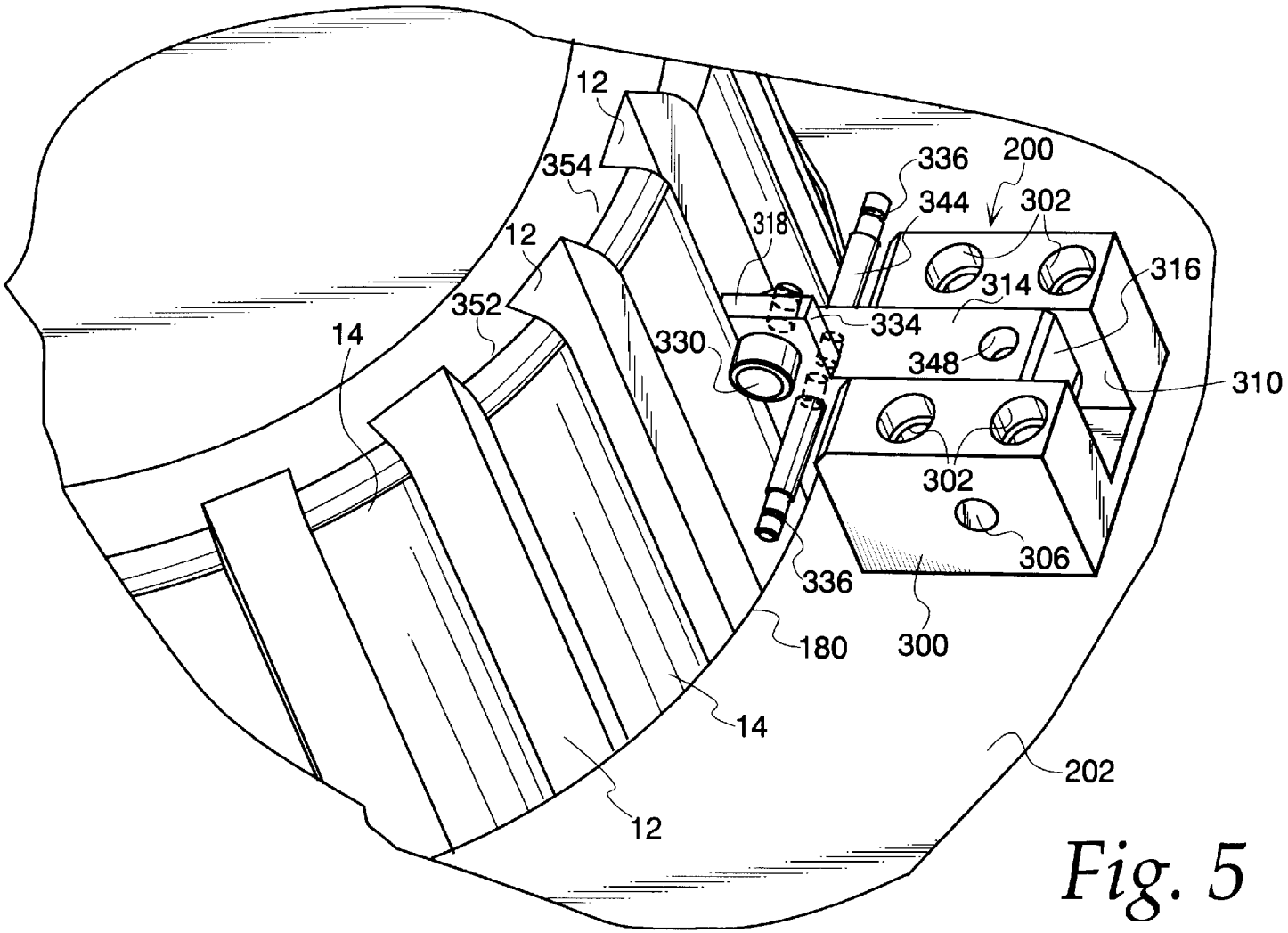
FIG. 5 is a fragmentary perspective view of the lower portion of the polishing machine.
Figure 6:
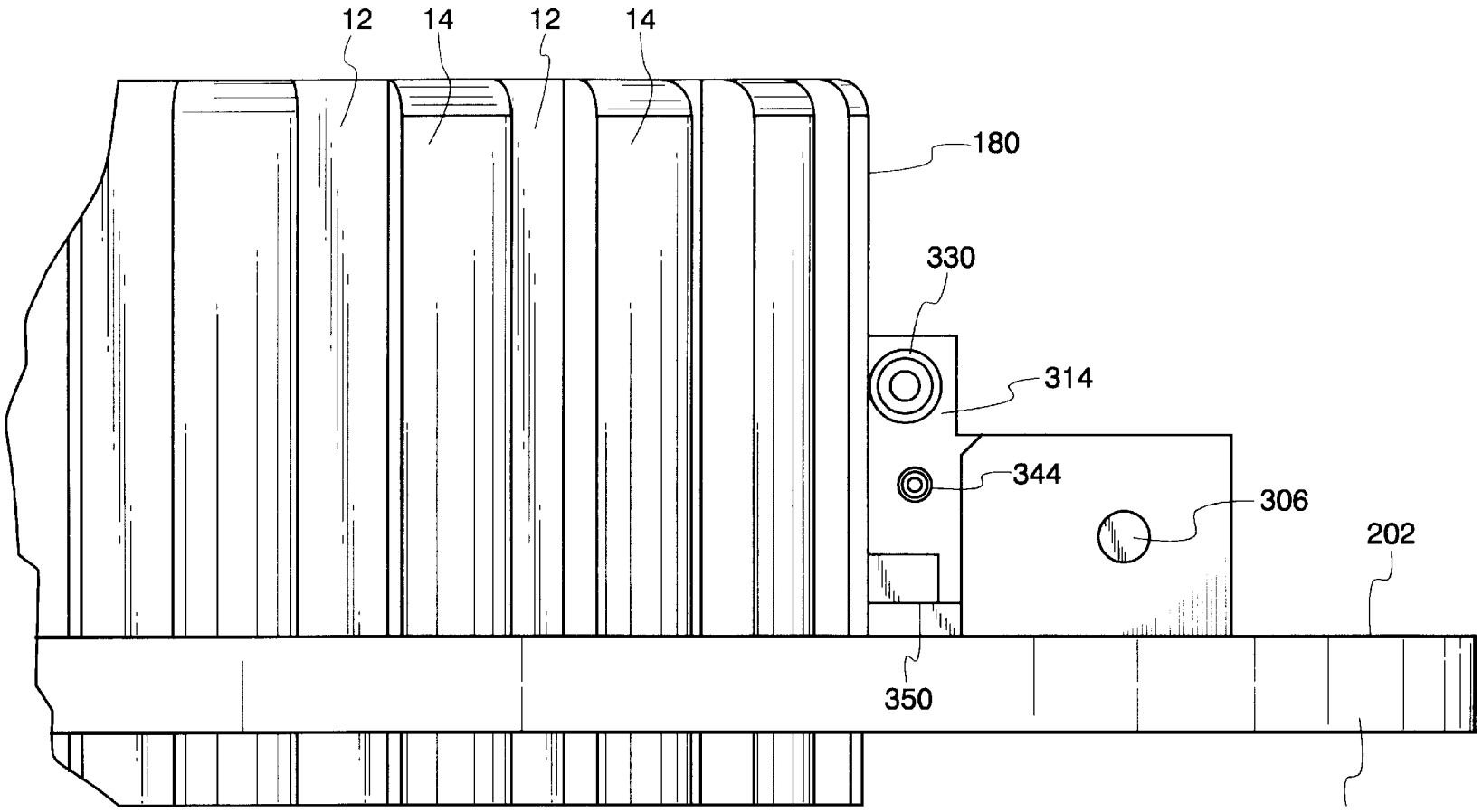
FIG. 6 is a fragmentary elevational view thereof.

Referring to FIGS. 4 and 5, drive hub 180 has a generally cylindrical configuration with an outer surface interrupted by slots 112 formed between vertically extending ribs 14. Drive hub 180 is powered from below by a drive motor 90. Referring to FIGS. 3 and 4, three equally spaced drive latch assemblies 200 are mounted on the upper surface 202 of a support plate 44 of the upper polish plate assembly 16. The drive latch assemblies 200 include drive latches 206 having radially inner ends received in slot 12 of drive hub 180. As schematically indicated in FIG. 2, drive hub 180 is rotatably driven by a motor 90 coupled to the lower polish plate by a transmission assembly 92. A position encoder wheel 94 is monitored by position sensors 95 which in turn are coupled to a control box 36. Accordingly, the drive latch assemblies 200 transfer rotational drive energy on drive hub 180 to the upper polish plate assembly 16.

Referring again to FIG. 4, lower polish plate assembly 20 includes an annular polish plate 22 supported from below by a drive table 23. Table 23 is in turn driven by a motor and transmission assembly, not shown in the drawings. As schematically indicated in FIG. 4, the lower polish plate assembly 20 defines a hollow central portion through which drive hub 180 and its related drive components extend, with operational capability free of constraint associated with the lower polish plate assembly.

Referring again to FIG. 3, workpieces 26 are disposed within carriers 24. Carriers 24 are preferably of conventional construction with outer edges carrying gear teeth which matingly engage a gear ring (not shown) for planetary drive of the carriers which rotate about their individual central axes as the upper and lower polish plates are rotated about their respective central axes. Preferably, the rotational speeds and directions of the carriers 24 and of the upper and lower polish plates can be independently controlled to achieve a variety of different polishing motions.

Figure 7:
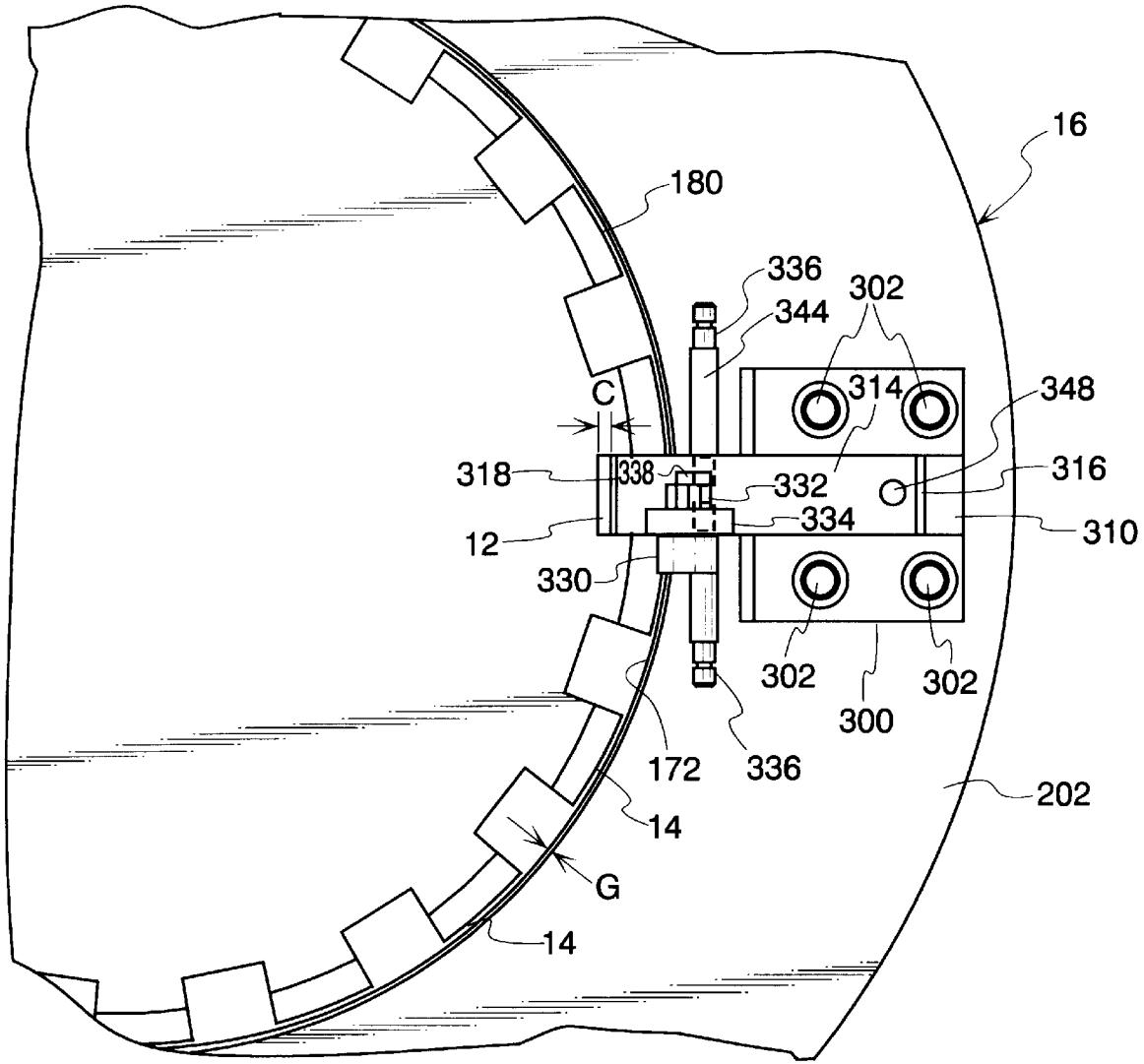
FIG. 7 is a top plan view thereof.
Figure 8:
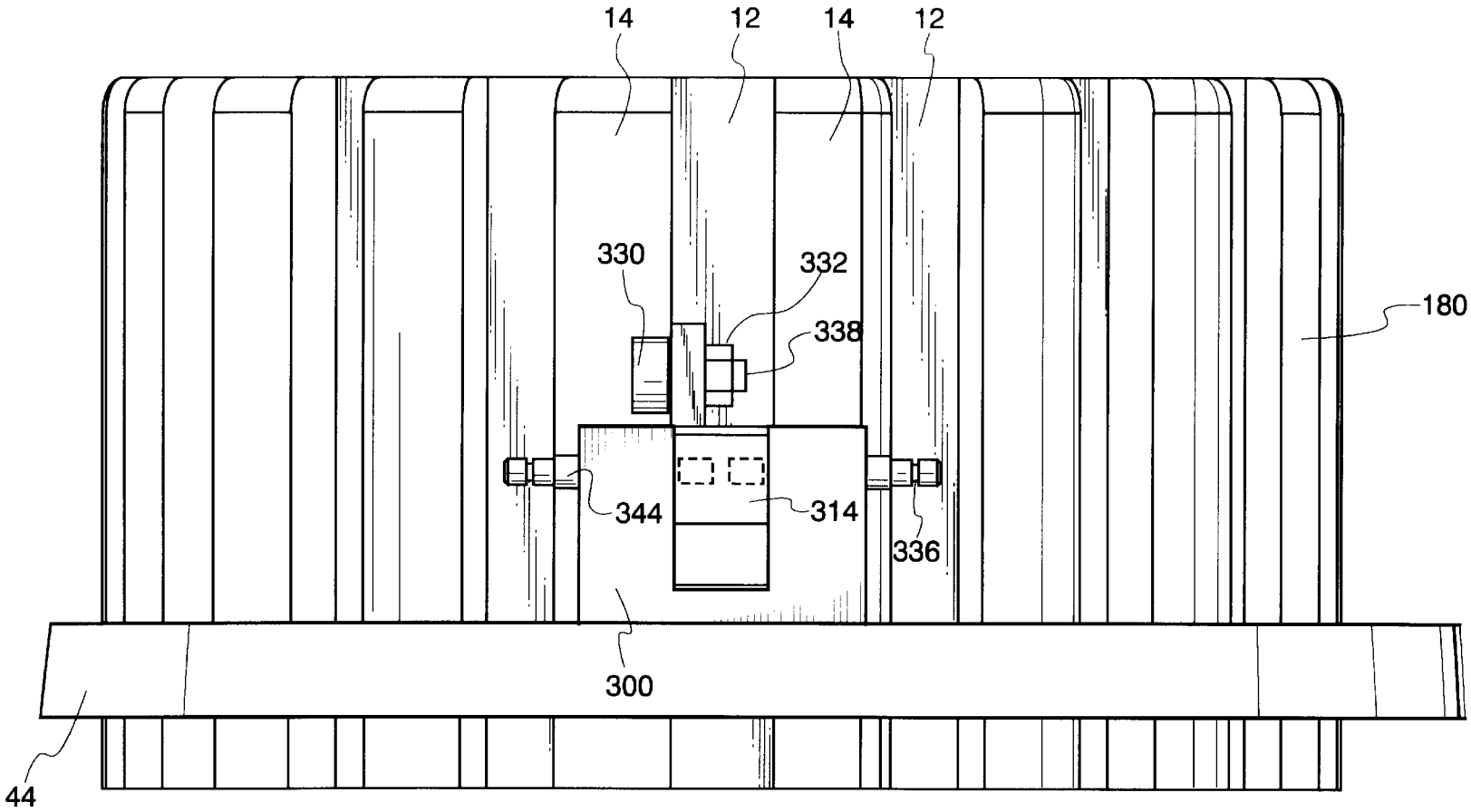
FIG. 8 is a side elevational view thereof.

As can be seen in FIG. 7, a slight gap G is provided between the inner bore wall 172 of the upper polish plate assembly and drive hub 180. Further, a slight clearance C is provided between the inner end 318 of a drive latch 314, mounted on upper drive plate assembly 16, and the slot formed in drive hub 180. During the course of developing the present invention, it has been learned that the random lateral excursions of the upper drive plate with respect to the drive hub during an ongoing polishing operation are due in significant part to localized friction "spots" which appear briefly at various points where workpieces contact either the upper or lower polish plate.

Several such friction spots can be observed during the duration of a polishing process, with the friction spots varying rapidly in size, magnitude of friction force, and location. For example, friction spots are observed during a changeover from polish to rinse or vice-versa, when local concentrations of deionized water are allowed to develop. Another mechanism associated with the development of friction spots is the receding of high spots on the various workpieces during a polishing operation which planarizes the workpieces. As a first "set" of high spots appearing on the workpiece surfaces are "leveled", new sets of high spots are continually being developed.

In a commercial operation, multiple workpieces are carried on a single carrier and multiple carriers are polished in a given operation, with the carriers traveling in a planetary motion about the drive hub. From time to time, workpieces brought close to one another by the planetary motion may cause a concentration of friction forces in a localized area of the upper or lower drive plate. Such friction forces effectively combine to impart a constraint on the motion of the polish plate, briefly setting up an eccentric pivot point about which the drive plate attempts to shift in an off-center pivoting motion, thus causing a lateral dislocation of the drive plate with respect to the drive hub.

As mentioned, in the class of machines of interest, the upper polish plate is telescopically lowered onto an upwardly protruding drive hub. Accordingly, a certain amount of clearance between the journaled diameter of the upper polish plate and the drive hub must be provided in order to assure adequate telescopic movement of the upper polish plate with respect to the drive hub. In the present invention, attention will be confined to lateral shifting of the upper drive plate only.

It is to be assumed for the purposes herein, that the drive hub 180 is perfectly stable in a practical sense, with its central axis of rotation remaining unchanged. However, the same is not true of the upper polish plate assembly. As mentioned above, the upper polish plate is, in effect, hangingly suspended from the main lifting cylinder 30 and, with the lift rod 32 fully extended, as shown in FIG. 2, lateral support of the upper polish plate is necessarily compromised.

As mentioned above, drive latches (mounted so as to extend in a generally radial direction) are received in slots formed in the drive hub. Lateral dislocations of the type described above cause the drive latches to shift in radial directions with respect to the central axis of the drive hub. At the same time, non-radial forces are applied to the drive latches by the friction induced pivotal shifting of the upper drive plate. The depth of the grooves formed in the drive hub are sufficient so as to confine, i.e., support, the drive latches against a circumferential or other non-radial displacement. Movement of the upper polish plate and the attendant forces applied to the drive latches are aggravated by the drive latches being able to shift within the drive hub slots (i.e., shift in radial directions toward and away from the central axis of the drive hub). As will be seen herein, provision is made to limit the depth of insertion of the drive latches with respect to the drive hub slots. However, it was found important during development of the present invention to also restrain the hanging support for the upper polish plate in addition to providing depth limiting to the drive latches.

It can be seen that the upper polish plate is hangingly suspended from the main lifting cylinder 30, which moves the upper polish plate assembly toward and away from the lower polish plate. Heretofore, single-ended lifting cylinders have been employed and have been found sufficiently satisfactory for their lifting functions. Close tolerance machining and careful assembly of the polishing machine were previously believed to provide adequate constraint of the upper polish plate and that the use of a single-ended main cylinder was consistent with the levels of restraint against sideways displacement. However, during development of the present invention, sideways movement of the upper polish plate is more closely constrained.

The resulting improvement in focus, or alignment, of the upper polish plate enabled closer scrutiny of the main cylinder during a polishing operation (when no lifting was required the role of the main cylinder was previously seen to be largely insignificant). However, further analysis revealed that a more costly double-ended main cylinder, unnecessary for carrying out its primary lifting function, would provide a significant level of additional constraint in the motion of the upper polish plate during a polishing operation. The combination of a double-ended main cylinder and depth limiting stops provided on the drive latches and improved bracing and support, together produce a surprising increase in polishing performance and, perhaps even more importantly, in workpiece flatness tolerances.

Increased polish pad life provided by the present invention provides a very substantial operational improvement. In the class of machines of interest, polish pads are typically mounted with a contact adhesive to the working faces of the upper and lower polish plates. Those familiar with the art, as well as those familiar with replacing gaskets in general, will appreciate the difficulties encountered in replacing a relatively large sized, but relatively thin annular polish pad, especially one which has been compressed and "rolled out" by the operational processes involved. It is not uncommon to remove such polish pads in relatively small sized pieces, using solvents to loosen the old adhesive. Scrapers and the like techniques commonly employed in other disciplines are not suitable for use in high tolerance polish plates and thus, replacing polish pads is a time consuming, laborious process. In addition, high tolerance polishing machines are oftentimes operated in a clean room environment where dissolved adhesive and polish pad fragments, even in minute quantities, can be detrimental. The replacement of polish pads is inevitable, although lengthening polish pad life several times over can result in very substantial savings for commercial plant operation.

Turning now to FIGS. 5–9, drive latch assemblies 200 will be described in greater detail. As mentioned above with reference to FIG. 4, the drive latch assemblies 200 are mounted to the top surface 202 of upper plate assembly 16. A mounting block 300 is provided with a plurality of mounting holes 302 for this purpose. Mounting block 300 includes a transverse bore receiving an axle or pivot pin 306. As can be seen, for example, in FIG. 5, mounting block 300 has a central recess 310 receiving a flat plate-like drive latch 314 having a rearward end 316 and a forward free end 318. Latch 314 is pivotally mounted to block 300 by the pivot pin 306. Accordingly, latch 314 is free to pivot about its rearward end 316 so as to raise the forward end 318 out of engagement with slot 12 formed in drive hub 180.

Figure 12:
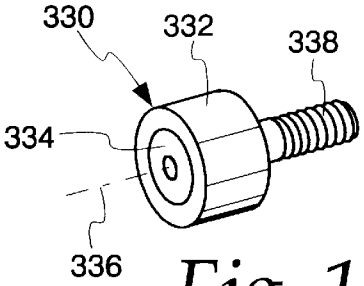
FIG. 12 shows a cam follower component thereof.

A conventional cam follower 330 is mounted to the forward end 318 of drive latch 314. Cam follower 330, as shown in FIG. 12, includes an outer sleeve 332 rotatably mounted about a core 334 with roller or needle bearings (not shown) for rotation about a central axis 336. A threaded shaft 338 extends from core 334 to provide a convenient mounting to latch plate 314. As can be seen, for example, in FIG. 7, a nut fastener 332 secures the cam follower to drive latch 314. As shown in the preferred embodiment, the major body portion of drive latch 314 is relatively massive compared to the upstanding mounting portion 334 to which cam follower 330 is secured. The reduced thickness mounting portion 334 is provided for convenience in fabrication and for weight reduction. If desired, the full thickness of drive latch 334 could be maintained throughout and, if necessary, a blind hole could be employed to accommodate nut fastener 332 on threaded shaft 338 which, as can be seen in FIG. 7, is substantially shorter than the full thickness of drive latch 314.

As schematically indicated in FIG. 7, drive latch 314 is made to have a substantially uniform width between its forward and rearward ends 318, 316. The width of drive latch 314 is controlled to a relative close tolerance and is made only slightly smaller than the width of slots 12. Accordingly, drive latch 314 is free to slide in and out of slots 12, with pivoting of drive latch 314 about its rearward end. If desired, drive latch 314 can be fixably secured to mounting block 300, with the drive latch 314 telescopically traversing slots 12 as the upper polish plate assembly 16 is moved toward and away from the lower polish plate.

Figure 9:
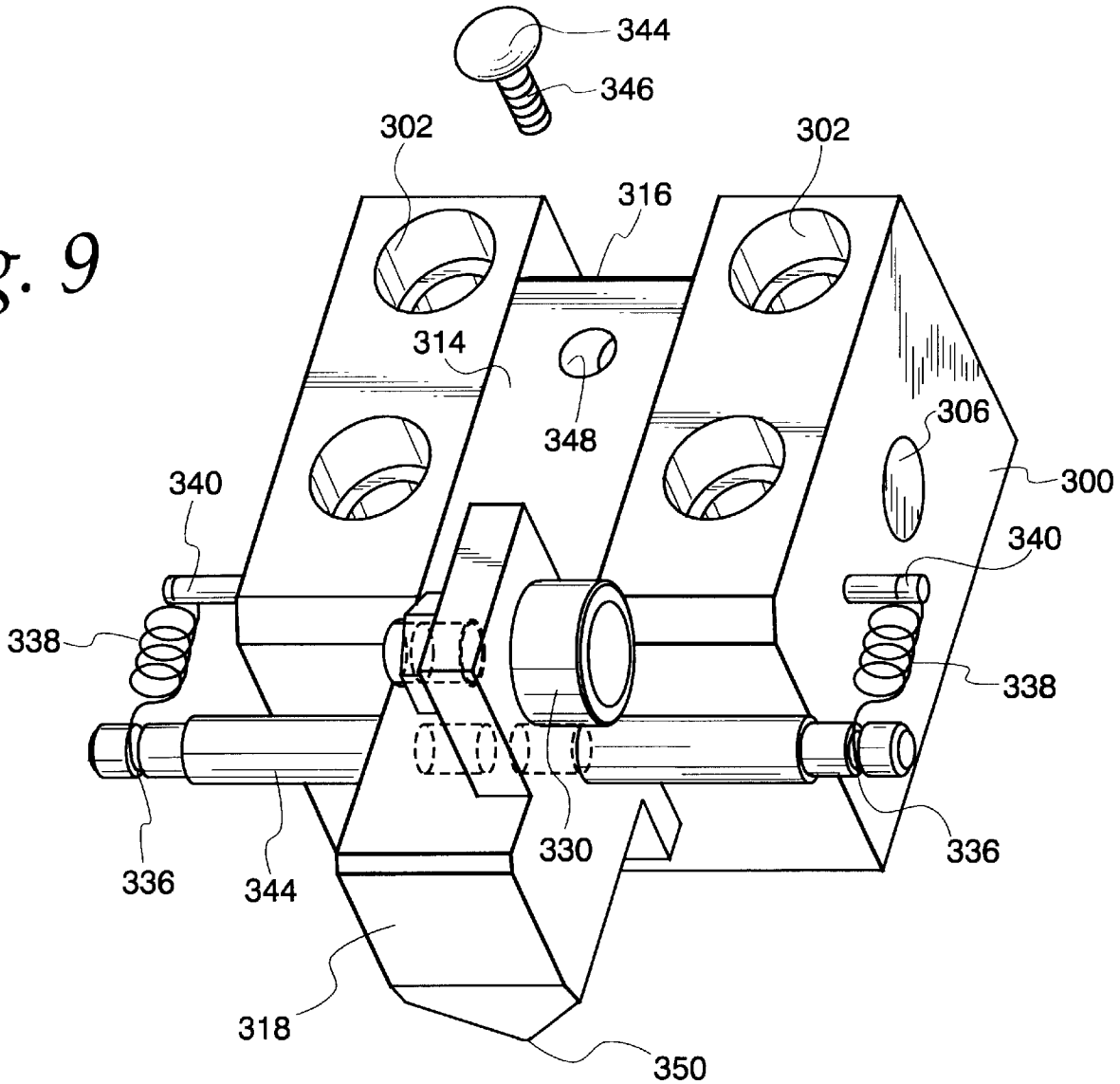
FIG. 9 is a perspective view of a drive latch assembly.

With the provision of pivot mounting 306, drive latch 314 can be conveniently swung out of engagement with drive hub 180 at the conclusion of a polishing operation, prior to raising of the upper polish plate assembly. It is desirable in this event, to provide a secure "parking" position for the forward end 318 of the drive latch. Accordingly, a double ended post 344 is provided with recesses 336 to receive the looped ends of coil springs 338, as can be seen in FIG. 9. The other ends of the coil springs 338 are secured to mounting pins 340 extending from the opposed sides of mounting block 300. In this manner, drive latch 314 is provided with a toggle arrangement in which the drive latch can be made to "snap" into an upper retracted position, withdrawn from slots 12 and maintained in the retracted position despite vibrations during subsequent machine operation.

If desired, an optional mounting handle 344 or other expedient can be attached to drive latch 314 for manual operation in retracting the drive latch 314 out of engagement with drive hub 180. As seen, for example, in FIG. 9, ball-shaped handle 344 is provided with a threaded stem 346 for convenient engagement with threaded aperture 348 formed adjacent the rearward end 316 of drive latch 314.

The springs 338 also provide a convenient spring loading of the forward end 318 of the drive latch, to aid in engagement with drive hub 180 preparatory to a polishing operation. In the preferred mode of operation, the drive latches 318 are lowered to the position shown in FIGS. 5–9, for example, while the upper polish plate assembly is raised above the lower polish plate, as shown, for example, in FIG. 1. As the upper polish plate assembly 16 is lowered, the bottom forward edges 350 of the drive latch (see FIG. 9) will either pass directly into slots 12 or will contact the upper ends 352 of ribs 14 depending on the relative alignment of the drive hub 180 with respect to the upper polish plate assembly.

With spring loading of the drive latch 314, if the bottom forward edges 350 should contact ribs 14, the drive latches will automatically pivot out of the way without causing harm to the polishing machine as the drive hub 180 is received in the central aperture of the upper polish plate assembly. In this event, the forward lower edges 350 of the drive latch will ride across the outer face of ribs 14 until the upper polish plate assembly comes to rest. Thereafter, the drive hub 180 can be "jogged" a slight amount, allowing the downwardly biased drive latches to pass into the slots 12. Accordingly, as can be seen in FIG. 9, the bottom of forward drive latch end 318 is preferably provided with a V-shaped or wedge configuration so as to readily "drop" into slots 12 as the drive hub is jogged.

As schematically indicated in FIG. 7, the inner bore 172 is only slightly larger than the outer circumference of drive hub 180 (measured at the exposed outer face of ribs 14) and the gap G between the outer surfaces of ribs 14 and the inner bore 172 of the upper polish plate assembly is relatively small relative to the overall diameters of the polish plates and drive hub. The above-mentioned friction forces developed between the workpieces and the upper polish plate cause the gap G to become smaller at one portion of machine 10 (causing drive latch 314 to be further inserted within slot 12) while in an opposite portion of the machine the gap will be enlarged (causing the drive latch 314 at that location to partially withdraw from its associated slot 12). As mentioned above, it is assumed for the purposes herein, that the drive hub 180 is maintained in a coaxial arrangement with the lower polish plate to a high degree of accuracy, assumed herein to be substantially perfect in a practical sense.

As friction forces are developed between the workpieces and the upper polish plate, the upper polish plate is made to undergo a lateral excursion, as mentioned above. The drive hub and drive latch assemblies are constructed such that the mechanical integrity of these massive components is not of particular concern during excursions of the upper polish plate. However, such excursions have a direct effect on the polishing operation since an unwanted motion between the workpieces and polish plates is experienced. Although the gap G may appear small compared to the other dimensions of the polishing machine, a noticeable detrimental effect on polishing operations has been observed where polishing requirements of the highest accuracy and position are sought. By providing cam followers 330 in the manner described, lateral excursions of the upper polish plate assembly with respect to the drive hub are minimized to a greater extent with a significant observed performance in polishing results.

Limiting lateral excursion at a point very close to the workpiece in the manner shown in FIGS. 5–9 has been found to be effective in improving polish performance. As mentioned, it has also been found important to stabilize the opposite end of lifting rod 32, i.e., its upper free end 32*a*. This is conveniently achieved by replacing previous single-ended lifting cylinders with double acting or double-ended lifting cylinders such as the cylinder 30 illustrated in the figures. Further, with the additional support of the upper and lower ends of the main lifting cylinder, provided by bracing and support plates, alignment of the lifting rod 32 with the lower polish assembly is improved, throughout the various operating conditions of the polishing system. For example, improved alignment is maintained as the upper polish assembly engages drive hub 180 thus assuring a smooth transition between the operating modes of the upper polish assembly in which the upper polish assembly is either engaged or disengaged from the rotational drive provided by hub 180.

Although the rotation rates of the drive plates are relatively slow, due to the large mass of the components involved, vibrations during an ongoing polishing operation must be carefully controlled. For example, as mentioned above, localized "dry spots" or areas of high friction have been observed during polishing operations, particularly when there is a change-over from one polishing media to another (e.g., slurry or deionized water). During these conditions, unbalanced forces are developed in the upper polish plate assembly which, as mentioned above, causes a loading of the cam followers to occur, and also a sideways or lateral force to be applied to the lifting rod.

Although the cam followers are adequate to restrain motion of the upper polish plate, it has been found desirable over repeated cycles of operation to provide improved restrainment for the upper end of lifting rod 32, through the combination of the bracing and support of the double acting cylinder 30 and the cam followers which cooperate so as to maintain an improved focus of the upper and lower polish plate assemblies during subsequent cycles of operation. Their enhanced support and cam followers 330 have been found to play an important role in this regard, as well.

Several variations in the drive latch assemblies is possible. For example, the cam followers 30 can be either of the conventional concentric or eccentric cam roller type. Further, as can be seen, for example, in FIG. 7, conventional cam followers having cylindrical outer surfaces are preferably employed. Due to the part cylindrical outer surface configuration of the ribs 14, a point contact between rib and cam follower results. This has been found to be favorable compared to a blunt, large area contact with the forward end 318 of the drive latch (see FIG. 9), should the drive latch be allowed to bottom out within slot 12. If desired, the outer surface of cam follower 330 can be made to conform to the part cylindrical outer surface of ribs 14 so as to form a line contact with the ribs.

In the preferred embodiment, during initial set-up procedures, a small spacing is introduced between the outer surfaces of the ribs and the radially innermost surfaces of the cam followers. The spacing is made to be uniform throughout the entire circumference of the drive hub and the various drive latch assemblies mounted throughout the upper polish plate assembly.

By confining contact with the drive hub 180 at points immediately adjacent the drive latch 314, bending or other distorting forces experienced by the drive latch are substantially reduced. For example, if cam followers were installed at points located between the various drive latch assemblies, the resulting contact with the cam followers (even if successful in limiting insertion of the neighboring drive latch within its respective slot), would give rise to distorting forces acting in directions tangential to the outer surface of drive hub 180, applied latch 314 at its weakest point. By mounting cam followers directly on the drive latches, such distortion forces are reduced to a minimum, and effectiveness of depth limiting is maximized.

Figure 11:
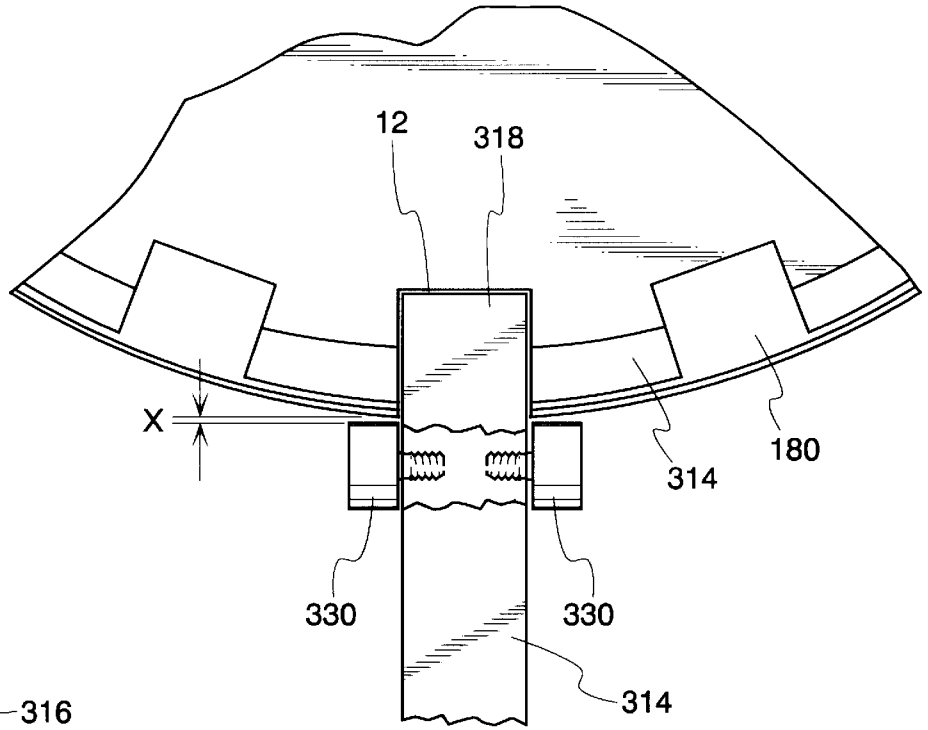
FIG. 11 is a top plan view thereof.
Figure 10:
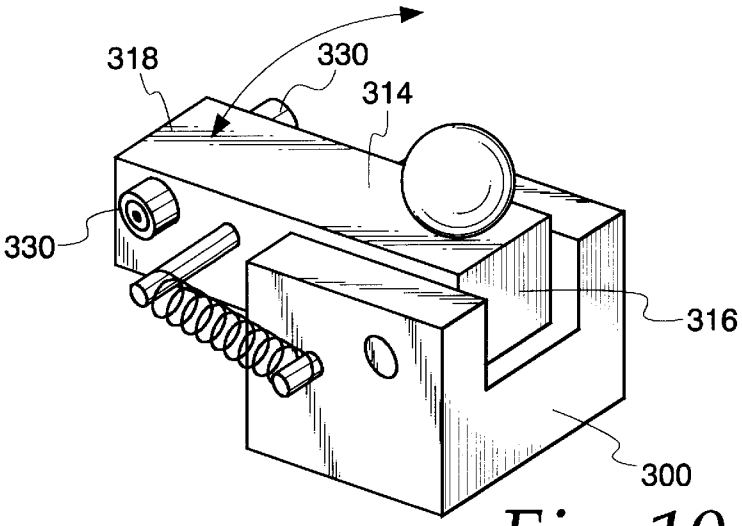
FIG. 10 shows an alternative drive latch assembly.

With reference to FIG. 10, other variations are possible. For example, as noted above with reference to FIG. 8, by employing a single cam follower, only one-half of the drive latch is directly stabilized during contact with drive hub 180. If additional support is required, the arrangements shown in FIGS. 10 and 11 could be employed where a pair of cam followers 330 are mounted at the forward ends 318 of drive latch 314. In this manner, two points of contact are established, immediately adjacent each side of the drive latch. Further, as noted above, the generally cylindrical cam followers 330 could be replaced by cam followers having outer surfaces closely conforming to the part circular configuration of ribs 14. If desired, both concentric and eccentric cam followers may be employed.

Figure 13:
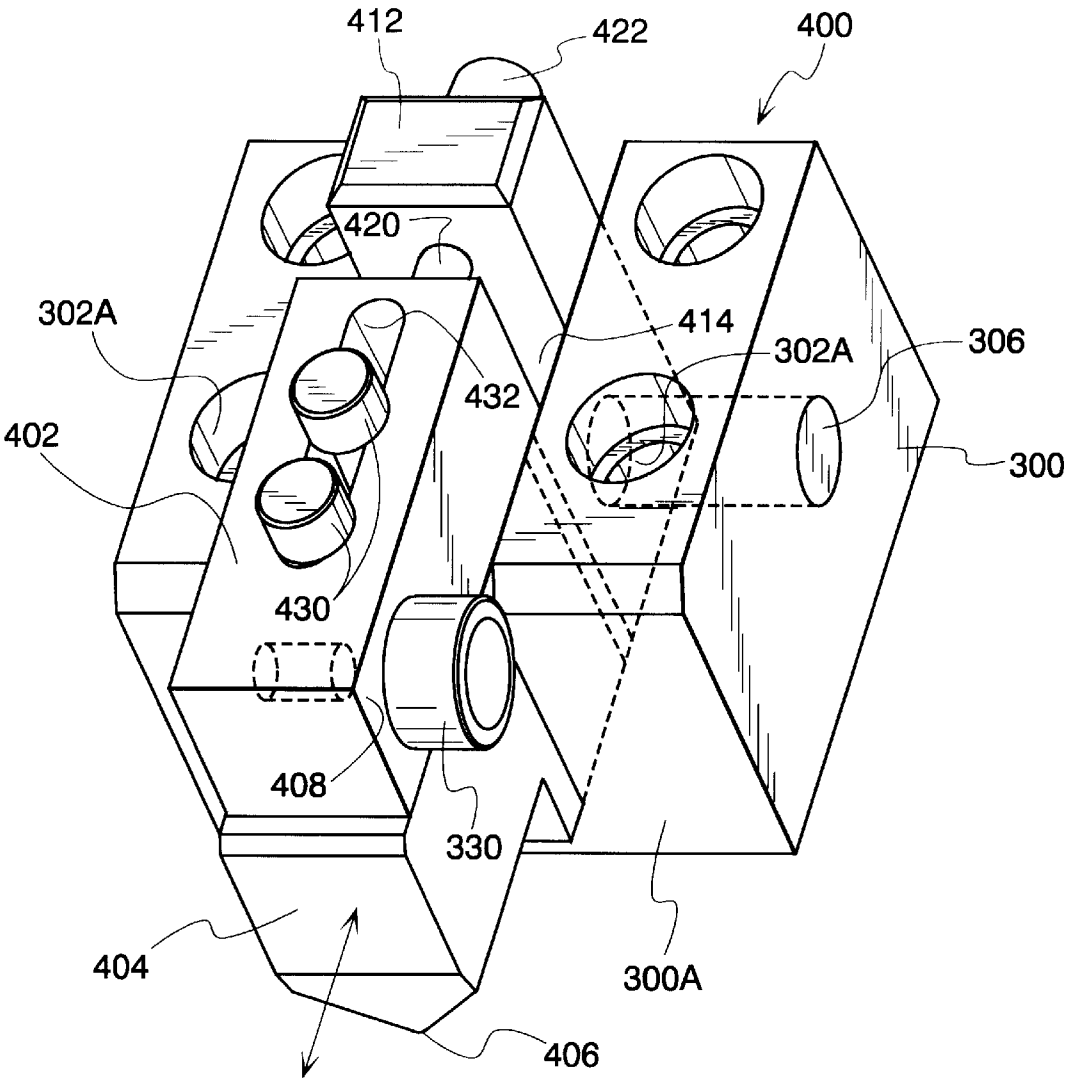
FIG. 13 is a perspective view of another alternative drive latch assembly.
Figure 14:
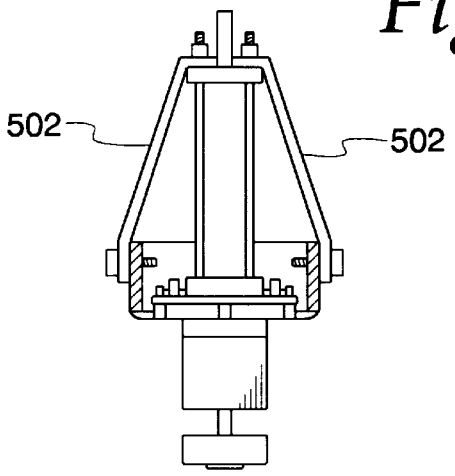
FIG. 14 is a fragmentary cross-sectional view taken along the line 14—14 of FIG. 1.

Further variations are also possible. For example, referring to FIG. 13, a modified drive latch assembly is generally indicated at 400. Drive latch 402 has a shape generally resembling the drive latch 314 described above and, for example, includes a similarly configured forward end 404 with a V-shaped bottom edge 406. As can be seen in FIG. 13, cam follower 330 is mounted to a more massive upstanding portion 408, preferably comprising a monolithic extension of forward end 404.

Unlike the drive latch described previously, the drive latch of assembly 400 is preferably comprised of two parts, made movable one with respect to the other. The first part includes an upstanding block 412 joined to a base 414 which is pivotally mounted about pivot pin 306. Base 414 in this embodiment does not extend to the forward end 404 of the drive latch, but rather is terminated at a point adjacent the inner mounting holes 302*a*. A threaded shaft 420 is driven by an enlarged head 422 and is threadingly secured to upstanding block 408.

As threaded shaft 420 is rotated, upstanding block 408 and the forward end 404 of the drive latch are moved back and forth with respect to the inner face 300*a* of mounting block 300. Bolt fasteners 430 pass through an elongated slot 432 formed in the drive latch so as to threadingly engage the bottom portion of mounting block 300. After the desired extension of the drive latch is obtained with respect to the inner face 300*a*, bolt fasteners 430 are tightened to maintain the movable forward portion of the drive latch fixed in position with respect to the pivotally mounted rearward portion of the drive latch.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. Apparatus for polishing a workpiece, comprising:

a table for supporting the workpiece;

a frame extending above the table;

an upper polish head having an inner base wall defining a center opening and disposed above the table and movable toward the table so as to cooperate with the table to apply pressure to the workpiece to be polished, the upper polish head also movable away from the table to allow access to the workpiece for its removal from the apparatus;

a lifting cylinder having opposed upper and lower ends, carried by the frame with a portion of the lifting cylinder extending above the frame, the lifting cylinder suspending said upper polish head above the table by a lifting rod which is movable within the main lifting cylinder so as to move the upper polish head toward and away from said table;

bracing means extending from the upper end of the lifting cylinder to the frame;

a drive hub mounted on the table for rotation about a hub axis, and telescopically receivable in the center opening of the upper polish head so as to engage the upper polish head as the upper polish head is moved toward the table;

said drive hub defining a plurality of vertically extending slots, and the upper polish head including a plurality of drive latches extending into the center opening for mating insertion within the slots for transmitting rotational drive from the drive hub to the upper polish head;

each drive latch containing at least one depth limiting stop engageable with the outer surface of the drive hub so as to limit insertion depth of the drive latch within its mating slot during an ongoing polishing operation; and a double-ended main lifting cylinder suspending said upper polish head above the table by a lifting rod, the lifting rod movable within the main lifting cylinder so as to move the upper polish head toward and away from said table.

2. The apparatus of claim 1 wherein the cam followers are coupled to the drive latches by adjusting blocks adjustably fixed to the drive latches for movement toward and away from the free ends of the drive latches.

3. The apparatus of claim 1 wherein said roller cams comprise an eccentric cam follower mounted on the drive latches.

4. The apparatus of claim 1 wherein the drive latches are pivotally mounted on the upper polish head for movement into and out of engagement with the drive hub.

5. Apparatus for polishing a workpiece, comprising:

a table for supporting the workpiece;

a frame extending above the table;

an upper polish head having an inner base wall defining a center opening and disposed above the table and movable toward the table so as to cooperate with the table to apply pressure to the workpiece to be polished, the upper polish head also movable away from the table to allow access to the workpiece for its removal from the apparatus;

a double-ended lifting cylinder carried by the frame and suspending said upper polish head above the table by a lifting rod, the lifting rod movable within the main lifting cylinder so as to move the upper polish head toward and away from said table;

said frame including an upwardly opening channel, with the lower end of lifting cylinder disposed in the channel, the frame further including bracing means extending from the upper end of the lifting cylinder means to the channel;

a drive hub mounted on the table for rotation about a hub axis, and telescopically receivable in the center opening of the upper polish head so as to engage the upper polish head as the upper polish head is moved toward the table;

said drive hub defines a plurality of vertically extending slots, and the upper polish head including a plurality of drive latches extending into the center opening for mating insertion within the slots for transmitting rotational drive from the drive hub to the upper polish head; and each drive latch containing at least one depth limiting stop engageable with the outer surface of the drive hub so as to limit insertion depth of the drive latch within its mating slot during an ongoing polishing operation.

6. The apparatus of claim 5 wherein the cam followers are coupled to the drive latches by adjusting blocks adjustably fixed to the drive latches for movement toward and away from the free ends of the drive latches.

7. The apparatus of claim 5 wherein said roller cams comprise an eccentric cam follower mounted on the drive latches.

8. The apparatus of claim 5 wherein the drive latches are pivotally mounted on the upper polish head for movement into and out of engagement with the drive hub.

* * * * *